US009138803B2

(12) United States Patent
LaFay et al.

(10) Patent No.: US 9,138,803 B2
(45) Date of Patent: Sep. 22, 2015

(54) METHOD FOR IMPROVEMENT OF CASTING QUALITY

(75) Inventors: Victor S. LaFay, Cincinnati, OH (US); Mark Pine, Burbank, OH (US); Comelis Grefhorst, Winterswijk (NL)

(73) Assignee: S&B Industrial Minerals North America, Inc., Brunswick, GA (US)

( * ) Notice: Subject to any disclaimer, the term of this patent is extended or adjusted under 35 U.S.C. 154(b) by 595 days.

(21) Appl. No.: 13/525,733

(22) Filed: Jun. 18, 2012

(65) Prior Publication Data

US 2012/0325113 A1 Dec. 27, 2012

Related U.S. Application Data

(60) Provisional application No. 61/500,499, filed on Jun. 23, 2011.

(51) Int. Cl.

| | |
|---|---|
| ***B22C 1/00*** | (2006.01) |
| ***B22C 5/00*** | (2006.01) |
| ***B22C 1/26*** | (2006.01) |
| ***B22C 1/18*** | (2006.01) |
| ***B22C 5/18*** | (2006.01) |

(52) U.S. Cl.
CPC . *B22C 1/26* (2013.01); *B22C 1/181* (2013.01); *B22C 5/185* (2013.01)

(58) Field of Classification Search
CPC ..... B22C 1/181; B22C 1/26; B22C 5/185
USPC ..... 106/38.2, 38.22, 38.28, 38.9; 209/2
See application file for complete search history.

(56) References Cited

U.S. PATENT DOCUMENTS

| | | | | |
|---|---|---|---|---|
| 2,515,194 | A * | 7/1950 | Christensen | 209/3 |
| 2,941,942 | A * | 6/1960 | Dahlstrom et al. | 210/725 |
| 5,034,035 | A * | 7/1991 | Satmer et al. | 55/321 |
| 5,106,418 | A * | 4/1992 | Szepfoldi et al. | 106/38.51 |
| 5,163,562 | A * | 11/1992 | Wilhelm et al. | 209/2 |
| 5,238,976 | A * | 8/1993 | Iyer | 523/145 |
| 5,289,920 | A * | 3/1994 | Godderidge et al. | 209/2 |
| 5,587,008 | A | 12/1996 | LaFay et al. | |
| 6,554,049 | B2 | 4/2003 | Steele et al. | |
| 6,834,706 | B2 | 12/2004 | Steele et al. | |

FOREIGN PATENT DOCUMENTS

| | | | | |
|---|---|---|---|---|
| EP | 0 876 866 | A1 | 11/1998 | |
| EP | 2 191 909 | A1 | 6/2012 | |
| GB | 2238740 | A * | 6/1991 | B22C 5/10 |

OTHER PUBLICATIONS

Brown, A. "Graded Coal—Its Role in Iron Casting Production from Greensand Systems", Overseas Foundry, May 2011. Retrieved from the internet <URL: http://www.foundryworld.com/uploadfile/2011062942120921.pdf>.

Search Report and Written Opinion for corresponding International Patent Application No. PCT/US12/42913 dated Aug. 31, 2012.

Preliminary Report on Patentability for corresponding International Patent Application PCT/US2012/42913 issued Apr. 1, 2014.

Hadji, A.; Labed, L.; and Lemmoui, A., "Substitution de la Bentonite par les Fines Recuperees en Fonderie", Archives of Foundry, vol. 4, No. 13, 2004,—XP55185954.

Benchikha, Tahar; Hamoudi, Djamel-Eddine; Lemmoui, Abdenacer; Hadji, Ali: and Chabour, Salem, "Etude de L'influence de la Bentonite at de L'eau sur les Proprietes Thermophysiques et le Pouvoir Gazeifiant d'un Mouie a Vert", Annales de Chimie—Science des Mat PRG, vol. 26, No, 5, 1-11—XP004341621 (2001).

Extended European Search Report issued in related European Patent Application No. 12803420,4, dated May 3, 2015.

* cited by examiner

*Primary Examiner* — Anthony J Green
(74) *Attorney, Agent, or Firm* — Finnegan, Henderson, Farabow, Garrett & Dunner, L.L.P.

(57) ABSTRACT

Systems and methods for improved molding sand performance through use of recovered additives from the existing waste stream in a foundry. Sand, clay, and carbon-containing organic components are wet recovered from a green sand mold foundry dust recovery system. The sand and non-sand fractions may be further treated to reduce water content or adjust the levels of various components to generate a pre-mix additive for the generation of new green sand molds, that may display improved properties at ambient and high temperatures when compared to commonly employed traditional pre-mix. In some examples, pre-mixes having reduced sulfur content are obtained. In several embodiments, the non-sand fraction obtained from bag house dust or dust from mechanical reclamation includes increased levels of bentonite clay and carbon.

11 Claims, No Drawings

METHOD FOR IMPROVEMENT OF CASTING QUALITY

RELATED APPLICATION

This application claims the benefit of U.S. provisional application No. 61/500,499 filed Jun. 23, 2011.

BACKGROUND OF THE INVENTION

1. Field of the Invention

The present invention relates generally to the field of sand cast molding and to improvements in the founding of iron (and other metals) more particularly to improvements in sand molding media employed in forming molds into which molten iron is poured in the production of castings as it relates to the recovering of the molding media in a foundry.

2. Description of the Background

Green sand casting is a well-known process for forming cast metal articles. In this process, a casting mold for making castings, formed from molding media that is primarily sand and bentonite clay for the production of one or multiple castings. Once the casting solidifies in the mold, the mold is broken down and the casting cycle is complete. A portion of the molding media can be recycled for another casting process, however, a substantial portion of the molding media exits the foundry as foundry waste. In the U.S. alone, foundry waste accumulates at a rate of approximately 6 to 10 million cubic yards per year. The large volume of foundry waste coupled with the increasing cost of landfill acreage and transportation is problematic.

Founding is an ancient art in which a cavity is defined in a sand mold and then molten metal poured therein. After the metal cools, the cast article is removed, with the sand mold usually being broken up in the removal process. The usual and basic procedure for forming such sand molds is to compact a sand molding medium around a pattern and then to remove the pattern, leaving a cavity having the configuration of the pattern.

In order for the sand to maintain its molded, cavity-defining configuration, a binding agent that causes the sand particles to cohere is included in the mixture. Clay has long been an accepted and suitable binding agent. Clay is a generic term and encompasses a large group of hydrous alumino-silicate minerals. Individual mineral grains vary in size down to microscopic dimensions. When dampened, clay is tenacious and plastic. When dampened and then dried clay becomes hard, particularly when dried at elevated temperatures. Wet bentonite product performs better under casting conditions.

The present invention is particularly useful in founding where so-called green sand casting is a standard practice. Green sanding casting encompasses a process wherein molten metal is poured into a sand mold while it still retains the moisture that has been added to actuate the cohesive properties of the clay. Sand molding media for iron founding comprise three basic components, namely sand, clay, and finely ground a bituminous coal, commonly known in the trade as "sea coal," In use, a sand molding medium is moistened with water to provide a medium that is capable of being compacted around a pattern to form a mold cavity. The green sand molds typically comprise by weight, from about 86% to 90% sand and multiple non-sand components, including 8% to 10% bentonite clay, 2% to 4% organic additives, and 2% to 4% moisture. After removal of the pattern, molten iron is poured into the mold cavity while the sand molding medium is still in its dampened or "green" condition. The sea coal on and immediately adjacent the mold cavity surface decomposes under the heat of the molten iron as it is poured into the mold. A product of this decomposition is elemental carbon, in the form of graphite, at the interface between the mold cavity and the poured iron. This elemental graphite serves the primary function of enabling the solidified casting to be released from the mold, free of sand particles. A secondary benefit of the elemental graphite is that it tends to level the surface of the mold cavity, thereby producing a smoother surface on the cast article.

A well-established practice of the trade is for a foundry to purchase a "pre-mix," which includes a clay component and carbon component. The foundry then mixes the pre-mix with sand from a local source to provide the sand molding media used in operations.

Sand molding media has sufficient cohesive strength of the sand molding medium is most critical in its "green" condition, that is, when it is moistened. After being compacted to define a cavity, the green molding medium preferably has sufficient strength to withstand any forces incident to removal of a pattern, so that the cavity configuration is maintained intact. Next, sand molding media, when in a green stage, preferably has sufficient strength to withstand the forces incident to the mold being moved and repositioned in various fashions in the process preparing it for the pouring of metal into the cavity. Further, the sand molding media preferably has sufficient cohesive strength to withstand the hydraulic forces incident to pouring molten iron into the cavity.

Drying of a green mold occurs extremely rapidly and can occur while the metal is still molten and continues to exert hydraulic forces on the mold structure. The dry strength of the molding medium is therefore critical in assuring that the integrity of the mold will be maintained to the end of obtaining cast articles of the proper configuration.

Another significant, objective characteristic of sand molding media is permeability. A relatively high permeability is preferred in order to prevent damage to the mold when molten iron is poured into the mold cavity. This is to point out that when molten metal is poured into the mold cavity, air is displaced though the mold medium. More importantly, because the sand molding medium is damp, steam can be generated in a rather violent, or explosive, fashion. Such steam is preferably vented through the molding medium with a minimum of gas flow resistance. As such, porous mold structures preferably have a relatively high gas permeability. Strength characteristics and permeabilities are capable of objective determination and acceptable green and dry strengths for sand molding media, as well as permeabilities, are now established.

After an item has been cast, the sand mold is broken up and then accumulated for reuse. The excess molding media, that is, foundry waste which cannot be reused for subsequent casting cycles, is generated at several locations within the foundry. The composition and particle size distribution of foundry waste can vary depending upon the areas of the foundry in which it is collected, but foundry waste can be generally classified in two broad categories, namely, "molding waste" and "bag house dust/dust from mechanical reclamation." The phrase "molding waste" refers to the excess molding media from broken-down green sand molds and cores, output stream, produced during shakeout. In many green sand foundries, the molding waste typically contains by weight from about 80% to about 90% sand, from about 6% to about 10% bentonite clay and from about 1% to about 4% organic additives. Molding waste includes sand that is coated with bond as well as individual particles of sand, bentonite, and organic additives.

Attempts have been made to reduce the accumulation of molding waste by mechanical reclamation removing the bond from the sand so that the sand is sufficiently clean to be reused in the production of cores. In such processes the sand is recovered, but the bentonite clay, which costs several times more than sand on a weight basis, and the organic additives can be recovered. A disadvantage of mechanical reclamation is that the cost of prime sand is sufficiently low in many geographic areas that the capital investment for sand recovery is economically unfeasible.

A large source of foundry waste stream includes fine particles of sand, bentonite clay, organic additives, and debris collected in the foundry's air evacuation system. This foundry waste is commonly known in foundries as "bag house dust." Bag house dust contains substantially more bentonite clay than does molding waste. Bag house dust typically comprises from about 40% to about 70% sand, from about 20% to about 50% bentonite clay, and from about 10% to about 30% organic additives. Previous efforts have disclosed hydraulic and mechanical separation processes that reclaim sand, bentonite, and organic components of bag house dust, though the utility of that recovery product is currently unknown. See U.S. Pat. Nos. 6,554,049 and 6,834,706.

Accordingly, there is a long-standing need to reduce the amount of foundry waste exiting a green sand foundry. There also exists a long-standing need for a process to recover sand that has sufficient quality to be used in the foundry to make cores and green sand molds and which can yield quality castings in a subsequent casting process. A process to recover sand, bentonite clay, and organic additives to decrease the amount of prime materials (pre-mix) that enter the foundry as raw material is also needed within the art. Over a period of time it becomes necessary to add fresh amounts of the clay and coal additive. Similarly, it is a common practice to also add fresh sand. This not only maintains a more or less constant ratio of the sand, clay, and coal components, but also compensates for the accumulation of ash that is a byproduct of the decomposition of the sea coal.

The pre-mix discussed above, which includes a clay component and carbon component, has found acceptance in the art because of several advantages. Primarily these advantages are found in the ability to minimize costs by the use of less pre-mix and/or by reducing the total amount of carbonaceous material in the pre-mix. Further, it was demonstrated that the amount of additional, "make-up" pre-mix used in recycling a sand molding medium was reduced.

Another factor to note is that as green sand molding medium is compacted around a pattern (in the normal case) to form a mold cavity. The characteristics of the sand molding medium can have a great impact on the "workability" of the medium and the ability to compact (i.e., densify) the medium and also the ease with which densification can be attained, which is understood as flowability. This factor is relevant to the fact that both the green strength and dry strength of a sand molding medium are directly proportionate to the density of the sand molding medium after it has been compacted to define a mold cavity. There is thus a preference within the art for sand molding media that have a workability characteristic which facilitates obtaining a desired, relatively high, and consistent density of the compacted molding medium. While the workability characteristic is subjective, it is, nonetheless, a recognized standard for sand molding media.

SUMMARY OF THE INVENTION

The present invention addresses the recovering of the molding media in a foundry which includes a clay component and carbon component. The present invention provides a supplemental additive for cast molding mixtures through recovering molding media in a foundry. The supplemental additive includes a clay component and carbon component supplemental. In some embodiments, the present invention thus provides a sand molding medium that possesses the appropriate characteristics for use in iron founding.

In certain embodiments, the present invention also achieves pre-mix and molding sand having low levels of sulfur (e.g., below 0.03% by weight). In many examples, the reduction of the quantity of elements such as sulfur occurs during decomposition of the hydrocarbon in the casting process. The present invention thus improves the ease with which sand molding media can be densified (defined as flowability) to thereby provide increased strength for the sand molding medium on a more consistent basis.

DETAILED DESCRIPTION OF THE INVENTION

It is to be understood that the figures and descriptions of the present invention have been simplified to illustrate elements that are relevant for a clear understanding of the invention, while eliminating for purposes of clarity, other elements that may be well known. The detailed description will be provided hereinbelow.

The present invention encompasses systems and methods that reduce overall waste at casting facilities while at the same time providing valuable pre-mix used in cast molding. As noted above, the process of breaking used sand molds after casting results in a significant volume of waste products. Some of that waste (molding waste) is unable to be reused in generating new sand molds and is handled manually for discarding.

A large volume of foundry waste, however, is captured by the foundry's air evacuation system. The air from the foundry facility is captured and passed through a large filtration system called a bag house. The solid particles collected there are generally referred to as "bag house dust" and is made up of substantial amounts of clay and organic material, in addition to sand. In some instances, bag house dust typically comprises from about 15% to about 70% sand, from about 10% to about 85% bentonite clay, and from about 10% to about 40% organic additives. The high levels of bentonite clay and organic additives present in bag house dust makes it a potentially valuable source of raw materials for the generation of pre-mix used in green cast molding.

The present invention utilizes captured bag house dust to generate pre-mix for cast molding. Initially, the sand and non-sand fractions of the bag house dust are separated from one another using standard prior art practices as disclosed in the references cited above, allowing for simple adjusting of component levels in the non-sand fraction. The high levels of clay and organic additives found in the non-sand fraction allow the bag house dust to provide important components for a casting pre-mix. In some embodiments, the non-sand fraction of the collected bag house dust also has low levels of other impurities (e.g., sulfur) when compared to commercially available pre-mix and thus represents an improvement over the prior art. In some embodiments, the sulfur may be less than 0.03% by weight of the mixture. The carbon component of the non-sand fraction has a loss on ignition content of about 3% and about 40%.

In some embodiments, the collected bag-house dust may be separated using a hydraulic separation process, either alone or in combination with other separation processes. Similarly, the water content of the recovered dust may be reduced through common prior art dewatering processes, such as cross-flow filtration. Water reduction of between about 10% and about 95% may be achieved in the non-sand component. The resulting slurry may contain a sand component, a non-sand component, or a combination of both components. If desired, the product may be dewatered completely as dictated by the demands of the specific project confronting the practitioner.

The relative levels of various components found in the non-sand fraction of collected bag house dust may be adjusted by addition of clay or organic compounds to achieve the appropriate concentrations to form an effective pre-mix composition. The specific amount of additives to include will depend on the specific composition of the bag house dust and one of skill in the art will recognize the appropriate levels needed for the bag house dust obtained. The pH of the pre-mix is generally basic and may be in the range of a pH of about 7 to about 11. Once established, the pre-mix may be combined with molding sand that has been previously used in a casting process to generate new molding sand able to use used effectively in casting processes.

In further describing the invention, several specific examples will be given. Each example discloses a batch of sand molding medium for forming moldings to be used in the casting of iron articles. The batches of sand molding media in the several examples have commonalities, which facilitate an appreciation of the improvements of the present invention.

The total weight of each example batch of sand molding medium is twenty pounds. Each batch includes a "pre-mix" having a "clay component" and a "carbon component." The pre-mix employed here is made up of 65% clay component and 35% carbon component. The clay component comprises 7% of the total weight of the batch at 1.4 pounds (635 grams) and the carbon component at 0.8 pounds (363 grams) for the 20 pound batches. The clay component from the recovered product evaluated was based upon foundry waste dust from a large North American iron foundry and the referenced comparison was 100% sodium bentonite clay. The sodium bentonite originates from natural clay deposits in the region of Colony, Wyo. and is characterized as including aluminum silicates in which sodium is the principal attached ion. These clays have been long used in sand molding media and their effectiveness is well established.

In each of the examples the balance of the batch, the pre-mix is added to and further includes common #520 silica sand. The sand and pre-mix are blended to form the molding sand medium for the examples below.

In each example water in the amount of about 1.0%-2.0% of the weight of the sand molding medium was added to moisten the medium to bring it to a green stage to meet a desired 45% compactability. The green sand molding medium of each example was then tested to determine its objective physical characteristics of green strength, dry strength, and permeability, and other accepted foundry testing methods as outlined by the American Foundry Society in their published Mold and Core Test Handbook, which is hereby incorporated by reference. The procedures can be found in their current edition published by the American Foundry Society (www.afsinc.org), 3rd Edition, 2001. The testing references included AFS 2110-00-s (Clay, AFS Method), AFS 2201-00-s, (Sand Mixture Preparation, Clay Method), AFS 2206-00-s (Tensile, Wet, Mold Sand), AFS 2204-00-s (Shear Strength, Green or Dried), AFS 2211-00-s (Methylene Blue Clay test), AFS 2218-00-s (Moisture Determination, Forced Hot Air Method), AFS 2220-00-s (Compactability of Molding Sand Mixtures, Rammer Method), AFS 2248-00-s (Friability), AFS 2249-00-s (Cone Jolt Toughness), AFS 5234-00-s (Compression Strength, Hot) and other test methods, all of which are incorporated by reference.

In each example below, the sand molding medium, in its green stage, is molded into a plurality of cylinders having a diameter of two inches and a height of two inches. The cylinders were compacted to different densities using pneumatic ramming to provide samples weighing 155 grams, 160 grams, and 165 grams. To evaluate a particular testing protocol the hot compression strength was determined at 4 temperatures 538° C. (1000° F.), 816° C. (1500° F.), 982° C. (1800° F.), and 1093° C. (2000° F.). The specimens were prepared using pneumatic squeezer method (AFS Mold and Core Test Handbook method AFS 2221-00-s) in plurality cylinders at 53 to 55 grams specimens based upon the density of the prepared molding sand.

The evaluation of the physical properties of the prepared sand mixture is generally conducted along the following standards.

Green Compression Strength—Higher values are preferred

Permeability—Higher values are preferred

Cone Jolt Toughness—Higher values are preferred

Dry Compression Strength—Higher values are preferred

Flowability—Lower values are preferred

Hot Compression Strength—Higher values at each temperature is preferred

EXAMPLE 1

The first example provides a benchmark for a basic sand molding medium where the total weight of each batch of sand molding medium is 20 pounds. The batch includes a pre-mix of a clay component and a carbon component. The pre-mix in the investigation was made up of 65% clay component (sodium bentonite) and 35% carbon component (sea coal). The clay component makes up 7% of the total weight of the batch at 1.4 pounds (635 grams) and the carbon component at 0.8 pounds (363 grams) for the 20 pound batches. This prepared sand mixture was mulled in a standard mixing unit known as a Simpson Laboratory Muller for 10 minutes. The time period of 10 minutes is considered desirable for appropriate mixing. Sand was added and the mixture had the following properties.

| Density (g/samp) | Green Compression Strength ($N/cm^2$) | Permeability ($cm^3/cm^3$) | Cone Jolt Toughness (Jolts) | Dry Compression Strength ($N/cm^2$) | Flowability (PSI) |
|---|---|---|---|---|---|
| 155 | 7.2 | 115 | 9 | 24 | 50 |
| 160 | 11.4 | 92 | 14 | 41 | 90 |
| 165 | 15.9 | 73 | 22 | 50 | 160 |

| Temp (° C.) | Hot Compression Strength in PSI |
|---|---|
| 538 | 90 |
| 816 | 408 |
| 982 | 218 |
| 1093 | 84 |

EXAMPLE 2

The second example provides an evaluation of the material from the recovery (having had moisture reduced per Example 6 below) of bag house dust for a basic sand molding medium where the total weight of each batch of sand molding medium is 20 pounds. The batch includes a pre-mix having a clay component and a carbon component. The pre-mix in the present example was made up of 65% clay component from the recovered bag house material and 35% carbon component from the recovered bag house material. The clay component makes up 7% of the total weight of the batch at 1.4 pounds (635 grams) and the carbon component at 0.8 pounds (363 grams) for the 20 pound batches. This prepared sand mixture was mulled in a standard mixing unit known as a Simpson Laboratory Muller for 10 minutes. The time period of 10 minutes is considered desirable for appropriate mixing. Sand was added and the mixture had the following properties.

| Density (g/samp) | Green Compression Strength ($N/cm^2$) | Permeability ($cm^3/cm^3$) | Cone Jolt Toughness (Jolts) | Dry Compression Strength ($N/cm^2$) | Flowability (PSI) |
|---|---|---|---|---|---|
| 155 | 8.0 | 138 | 22 | 42 | 60 |
| 160 | 12.7 | 111 | 33 | 56 | 100 |
| 165 | 16.7 | 85 | 49 | 69 | 160 |

| Temp (° C.) | Hot Compression Strength (PSI) |
|---|---|
| 538 | 152 |
| 816 | 534 |
| 982 | 318 |
| 1093 | 133 |

EXAMPLE 3

The third example provides an additional benchmark for a basic sand molding medium where the total weight of each batch of sand molding medium is 20 pounds. The batch includes a pre-mix having a clay component and a carbon component. The pre-mix of the present example was made up of 65% clay component (sodium bentonite) and 35% carbon component (sea coal). The clay component makes up 7% of the total weight of the batch at 1.4 pounds (635 grams) and the carbon component at 0.8 pounds (363 grams) for the 20 pound batches. This prepared sand mixture was mulled in a standard mixing unit known as a Simpson Laboratory Muller for 3 minutes. The time period of 10 minutes is desirable for appropriate mixing so therefore the 3 minutes mulling time was utilized to determine the temporal development of the physical properties. Sand was added and the mixture had the following properties.

| Density (g/samp) | Green Compression Strength ($N/cm^2$) | Permeability ($cm^3/cm^3$) | Cone Jolt Toughness (Jolts) | Dry Compression Strength ($N/cm^2$) | Flowability (PSI) |
|---|---|---|---|---|---|
| 155 | 5.7 | 102 | 5 | 12 | 50 |
| 160 | 8.1 | 77 | 9 | 23 | 90 |
| 165 | 10.5 | 63 | 11 | 23 | 160 |

| Temp (° C.) | Hot Compression Strength (PSI) |
|---|---|
| 538 | 56 |
| 816 | 233 |
| 982 | 138 |
| 1093 | 52 |

EXAMPLE 4

The fourth example provides an evaluation of the material from the recovery (having had moisture reduced per Example 6 below) of bag house dust for a basic sand molding medium where the total weight of each batch of sand molding medium is 20 pounds. The batch includes a pre-mix having a clay component and a carbon component. The pre-mix of the present example is made up of 65% clay component from the recovered bag house product and 35% carbon component from the recovered bag house product. The clay component makes up 7% of the total weight of the batch at 1.4 pounds (635 grams) and the carbon component at 0.8 pounds (363 grams) for the 20 pound batches. This prepared sand mixture was mulled in a standard mixing unit known as a Simpson Laboratory Muller for 3 minutes. The time period of 10 minutes is desirable for appropriate mixing so therefore the 3 minutes mulling time was utilized to determine the temporal development of the physical properties. Sand was added and the mixture had the following properties.

| Density (g/samp) | Green Compression Strength ($N/cm^2$) | Permeability ($cm^3/cm^3$) | Cone Jolt Toughness (Jolts) | Dry Compression Strength ($N/cm^2$) | Flowability (PSI) |
|---|---|---|---|---|---|
| 155 | 5.8 | 112 | 6 | 18 | 55 |
| 160 | 7.8 | 83 | 10 | 26 | 90 |
| 165 | 11.9 | 71 | 13 | 35 | 140 |

| Temp (° C.) | Hot Compression Strength (PSI) |
|---|---|
| 538 | 80 |
| 816 | 341 |
| 982 | 197 |
| 1093 | 100 |

EXAMPLE 5

The fifth example provides an evaluation of the material from the recovery of bag house dust compared to a traditional pre-mix. In the following example the sulfur content of the recovered bag house dust was analyzed compared to the sulfur content of the previously mentioned pre-mix that includes a clay component and a carbon component. The pre-mix in the investigation was made up of 65% clay component (sodium bentonite) and 35% carbon component (sea coal).

| | Sulfur Content in Percentage |
|---|---|
| Product generated using Bag House Dust | less than 0.03 |
| pre-mix 65% sodium bentonite/35% sea coal | 0.32 |

EXAMPLE 6

The sixth example provides an evaluation of material generated from the recovery of bag house dust that has had the water reduced. In the following example the pH of the slurry was monitored of the previously mentioned pre-mix that includes a clay component and a carbon component.

| Identification | Slurry prior to water reduction | Slurry after water reduction |
|---|---|---|
| pH | 8.6 | 8.6 |
| Total Solids (Average) | 10 to 14 | 27 to 29 |

As may be seen from the preceding examples, collected bag house dust compares favorably to commercially available pre-mix. Indeed, in many examples, the pre-mix generated from reclaimed bag-house displays better properties than traditionally available pre-mix (e.g., compare the properties of the pre-mix Examples 1 and 3 to those of Examples 2 and 4). The components and physical properties of the raw materials generated from bag house dust may be adjusted through addition of components or purification (e.g., through water reduction) to obtain appropriate final levels for a foundry-ready pre-mix. The present invention represents an improvement over prior art both in reduction of foundry waste and production of high quality pre-mix for casting processes.

Nothing in the above description is meant to limit the present invention to any specific composition or structure of components. Many substitutions are contemplated within the scope of the present invention and will be apparent to those skilled in the art. The embodiments described herein were presented by way of example only and should not be used to limit the scope of the invention.

We claim:

1. A method of forming a molding sand additive, comprising the steps of:

recovering a non-sand fraction from a green sand bag house dust recovery installation, wherein said non-sand fraction comprises a recovered clay component and a recovered carbon component;

recovering a sand fraction from the green sand bag house dust recovery installation;

reducing water content in said non-sand fraction; and adjusting the relative levels of clay and carbon in said non-sand fraction.

2. The method of claim 1, wherein said recovered clay component has a bentonite content between about 10% and about 85%.

3. The method of claim 1, wherein said recovered carbon component as a loss on ignition content of about 3% to about 40%.

4. The method of claim 1, wherein said reducing step achieves a water reduction of about 10% to about 95%.

5. The method of claim 1, wherein said adjusting step comprises addition of clay.

6. The method of claim 5, wherein said clay comprises bentonite.

7. The method of claim 6, wherein said bentonite comprises a sodium bentonite.

8. The method of claim 1, wherein said adjusting step comprises addition of organic compounds.

9. The method of claim 1, wherein said adjusting step comprises addition of coal.

10. The method of claim 9, wherein said coal comprises bituminous coal.

11. The method of claim 1, wherein the non-sand fraction has a sulfur content of less than 0.03% by weight.

* * * * *